US006371446B1

(12) United States Patent
Gauthier et al.

(10) Patent No.: US 6,371,446 B1
(45) Date of Patent: Apr. 16, 2002

(54) HAND-HELD PNEUMATIC CARPET STRETCHER

(76) Inventors: Kenneth C. Gauthier; Robert A. Bartz, both of P.O. Box 650, Crestline, CA (US) 92325

( * ) Notice: Subject to any disclaimer, the term of this patent is extended or adjusted under 35 U.S.C. 154(b) by 0 days.

(21) Appl. No.: 09/662,420

(22) Filed: Sep. 14, 2000

(51) Int. Cl.[7] ..... B25B 25/00
(52) U.S. Cl. ..... 254/201; 294/8.6
(58) Field of Search ..... 254/199, 200, 254/201, 210, 212; 294/8.6

(56) References Cited

U.S. PATENT DOCUMENTS

| | | | | | |
|---|---|---|---|---|---|
| 2,631,403 | A | * | 3/1953 | Hopkins | 254/200 |
| 3,963,216 | A | | 6/1976 | Victor | 254/62 |
| 3,980,274 | A | | 9/1976 | Ebert | 254/57 |
| 4,008,879 | A | | 2/1977 | Youngman | 254/57 |
| 4,042,211 | A | | 8/1977 | Hammond et al. | 254/57 |
| 4,084,787 | A | | 4/1978 | Kowalczyk | 254/57 |
| 4,627,653 | A | | 12/1986 | Koroyasu | 294/8.6 |
| 5,145,225 | A | | 9/1992 | Muller et al. | 294/8.6 |
| 5,228,660 | A | | 7/1993 | Massicotte | 254/201 |
| 5,472,170 | A | | 12/1995 | Anasson | 254/212 |
| 5,938,182 | A | | 8/1999 | Goodrich et al. | 254/209 |

* cited by examiner

*Primary Examiner*—Emmanuel M. Marcelo
(74) *Attorney, Agent, or Firm*—Welsh & Katz, Ltd.; Eric D. Cohen, Esq.

(57) ABSTRACT

A hand-held pneumatic carpet stretcher powered by an associated air compressor, or other source of compressed air, is used to eliminate wrinkles during the installation of wall-to-wall carpet. The carpet stretcher comprises a gripper plate, pile teeth, an air valve controlled by a button, and two pneumatic cylinders acting in conjunction with two piston rods connected to each other by a piston rod connector.

19 Claims, 4 Drawing Sheets

HAND-HELD PNEUMATIC CARPET STRETCHER

FIELD OF THE INVENTION

The invention relates to a hand-held pneumatic carpet stretcher. More particularly, this invention relates to a pneumatically actuated carpet stretcher used to eliminate wrinkles and creases during the installation of carpet.

BACKGROUND OF THE INVENTION

During the installation of carpet, carpet stretchers are often used to stretch carpet to eliminate wrinkles and creases. It is common to attach the carpet to a floor mounted wood strip or a tack strip having embedded upwardly extending pins for engaging the carpet. One end of a carpet is attached to the tack strip along one side of a room, and the carpet is then stretched to the opposite side of the room where the opposite end of carpet is secured to an opposite tack strip.

One known tool used to stretch carpet is referred to as a "kicker." This tool engages the carpet with a gripping head and is propelled forward when the operator repeatedly strikes a knee pad with his or her knee. The kicker is widely used and is popular for its ease of use, light weight, and mobility. The kicker, however, has several disadvantages. For example, carpet installers often incur chronic knee and back injuries from the repeated kicking motion during operation of the kicker.

Although carpet installers make up less than 0.06% of the U.S. workforce, they file 6.2% of all workers' compensation claims for traumatic knee injury. This rate is 108 times the expected rate and is the highest rate of any occupation reporting such claims.

To alleviate this problem, hydraulic and electric carpet stretchers have been suggested. The hydraulic powered carpet stretcher, however, is susceptible to undesirable hydraulic fluid leakage problems. An electric powered carpet stretcher, on the other hand, may create a dangerous electrical shock hazard. In addition, hydraulic and electric carpet stretchers are generally large, heavy and cumbersome, and therefore difficult to use.

Pneumatic carpet stretchers, conversely, are desirable because they are not susceptible to the hydraulic fluid leakage and electrical shock hazards to which hydraulic and electric carpets stretchers may subject. Pneumatic carpet stretchers, moreover, have a greater power to weight ratio than hydraulic and electric carpet stretchers. In addition, prior art pneumatic carpet stretchers are complicated, susceptible to large side loads, and have many moving parts. These pneumatic carpet stretchers, therefore, are more expensive to maintain.

Accordingly, there continues to be a need for a carpet stretcher that is light, easy to use, easy to maintain, and portable, but that does not cause the undesirable knee and back injuries to carpet installers that the kicker-type devices cause.

SUMMARY OF THE INVENTION

The invention is a hand-held pneumatic carpet stretcher powered by an associated air compressor or other source of compressed air. The carpet stretcher is used to stretch carpet and eliminate wrinkles during the installation of carpet.

The disclosed carpet stretcher includes two pneumatic cylinders that each has a bore formed therein. Each cylinder includes a piston configured to be sealingly received within the bore so that the piston forms an extension chamber and a retraction chamber within the bore. Each piston is operatively connected to a proximal end of a piston rod, which are connected to each other at their distal ends by a piston rod connector. A gripper plate is operatively coupled to the piston rod connector.

A multi-port air valve includes a pneumatic portion and an atmospheric portion, and is configured so that the pneumatic portion includes an extension port and a retraction port. The atmospheric portion includes an air compressor port, an extension vent and a retraction vent. The air valve is configured so that the air compressor port receives compressed air from an associated air compressor and directs the compressed air to the extension port or the retraction port.

The extension and retraction ports are in communication with the extension and retraction chambers, respectively. The retraction vent is open to the atmosphere when the cylinders are in an extension mode, and the extension vent is open to the atmosphere when the cylinders are in a retraction mode.

A user-operable button is operatively coupled to the air valve and is used to control the directing of compressed air. The button includes a palm lever and a valve stem, and is positioned on a rear portion of the hand grip so that the palm lever is aligned with and parallel to the hand grip. This permits a user to operate the button with the user's palm.

A stretcher head includes pile teeth to grip the carpet. The housing encloses the pneumatic cylinders and the air valve. A face plate includes auxiliary teeth formed on a bottom side of the face plate, and is removably attached to a front portion of the housing. A hand grip is attached to a top surface of the housing.

DETAILED DESCRIPTION OF THE INVENTION

Figure 1:
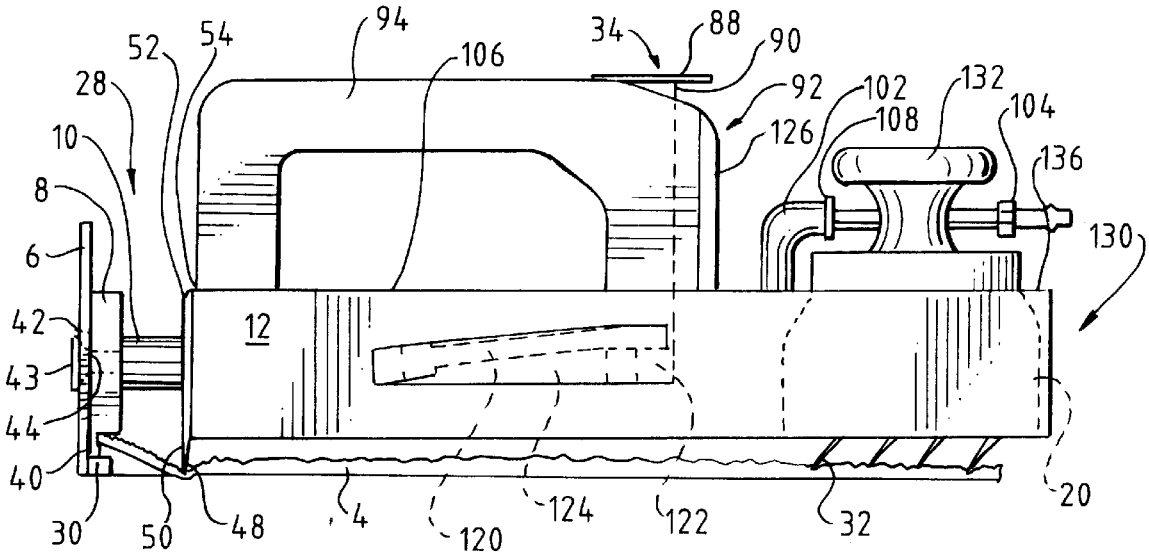
FIG. 1 depicts a cross-sectioned side view of an exemplary embodiment of a hand-held pneumatic carpet stretcher showing extension and retraction air lines.

While the invention is susceptible to embodiment in various forms, there is shown in the drawings, and will hereinafter be described specific embodiments with the understanding that the present disclosure is to be considered an exemplification of the invention and is not intended to limit the invention to the specific embodiments illustrated.

Referring now to FIG. 1, there is shown an exemplary embodiment of a hand-held pneumatic carpet stretcher 2 used to stretch carpet 4 and eliminate wrinkles during installation of carpet.

Figure 2:
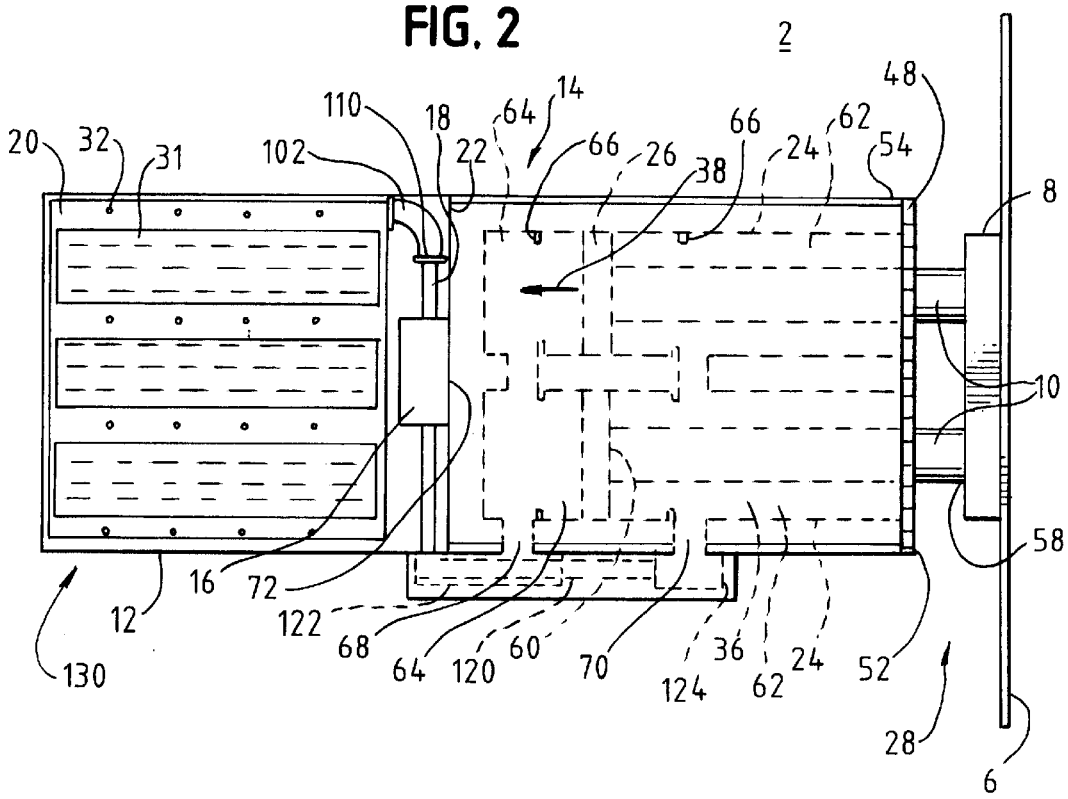
FIG. 2 depicts a bottom view of an exemplary embodiment of a hand-held pneumatic carpet stretcher showing a pneumatic cylinder assembly.

As shown in FIGS. 1–2, the carpet stretcher 2 includes a slotted gripper plate 6 that is operatively coupled to a piston rod connector 8. Two piston rods 10, arranged in a parallel orientation, are connected to each other by the piston rod connector 8, as best shown in FIG. 2. The carpet stretcher 2 also includes a detachable housing 12 that encloses a pneumatic cylinder assembly 14, a five way air valve 16, a high pressure air line 18, and a stretcher head 20.

The carpet stretcher 2 provides for easy access to concealed parts and therefore facilitates easy maintenance. The detachable housing 12 can be attached to the pneumatic cylinder assembly 14 by fasteners, such as, for example, nuts and bolts or screws. A user can remove the detachable housing 12 permitting easy access to and service of the pneumatic cylinder assembly 14, the five way air valve 16, and the high pressure air line 18.

In addition, the present invention incorporates a simple design that allows for a light weight and compact hand-held pneumatic carpet stretcher 2 that provides advantages over carpet stretchers disclosed in the prior art. For example, the design of the disclosed carpet stretcher 2 allows for low maintenance and extended durability while the light weight and compact nature of the carpet stretcher 2 facilitates easy transportation and use.

The carpet stretcher 2 shown in FIG. 2 incorporates a pneumatic cylinder assembly 14 that utilizes a pneumatic cylinder housing 22 to enclose two pneumatic cylinders 24 arranged in a parallel orientation. In other embodiments, more than two pneumatic cylinders may be used. The use of a two-cylinder or a multi-cylinder assembly has a width to height ratio of about 3.0 to 1, however any width to height ratio of at least about 2.0 to 1 is acceptable. The specified width to height ratio assures a wide, low profile, non-tipping platform of the carpet stretcher 2. Of course, the more cylinders used, the greater the width to height ratio. It should be noted, however, that a single pneumatic cylinder may also be used so long as the width to height ratio of the single cylinder pneumatic cylinder assembly approximately conforms to the specifications described above.

The use of a wide, low profile platform allows the carpet stretcher 2 to maintain a low center of thrust while still being actuable by a compressed air source that has a power rating of about 80 to 120 psi. The low center of thrust, meaning that the carpet stretcher is in close proximity with the carpet 4 surface, reduces the amount of side load or torque to which the carpet stretcher 2 may be subject during operation. Tipping, which is caused by high side loads and pulling forces, is therefore reduced by the low profile design.

In addition, the low center of thrust and low profile design reduces high stress and cyclic stress on seals (not shown) of the cylinders, the slotted gripper plate 6, and pistons 26 of the cylinders 24. Reduced stress on the seals, the gripper plate 6, and the pistons 26 improves the fatigue life of the carpet stretcher, which in turn, allows for lighter materials to be used in the manufacture of the carpet stretcher.

Figure 3:
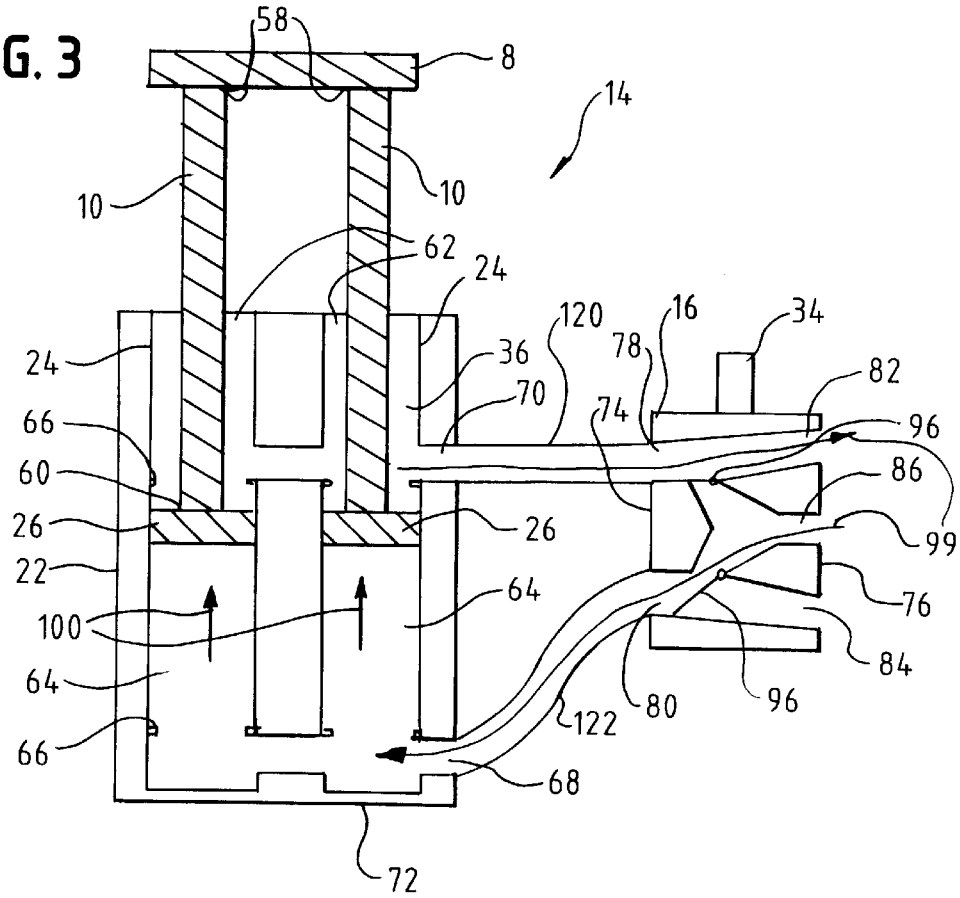
FIG. 3 depicts a schematic air flow diagram showing air flow when the hand-held pneumatic carpet stretcher is in an extension mode.
Figure 4:
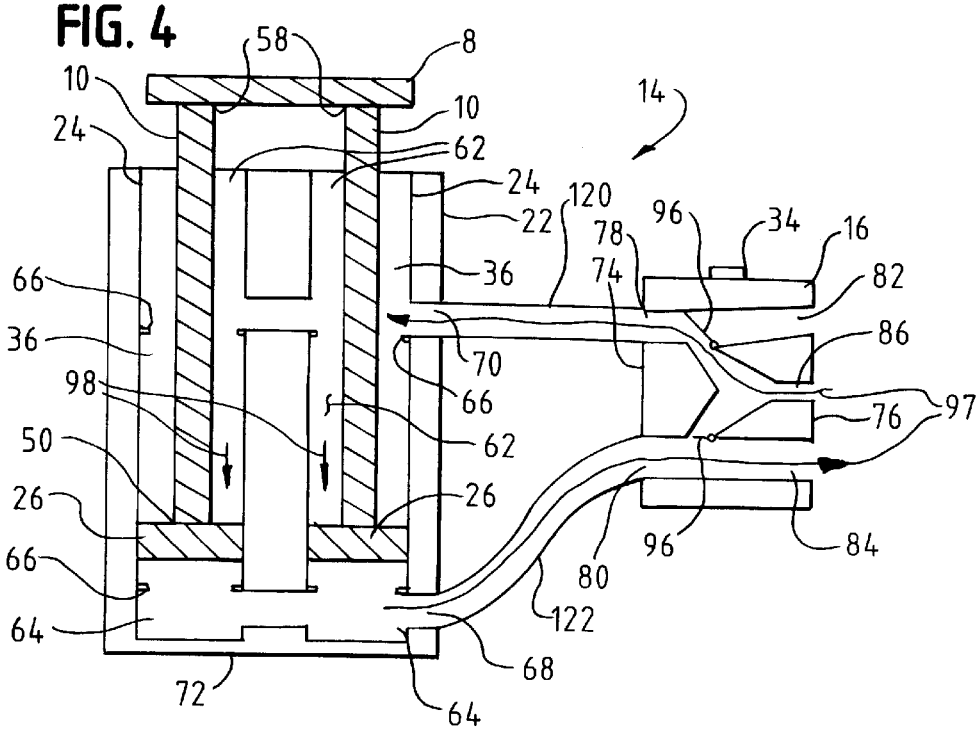
FIG. 4 depicts a schematic air flow diagram showing air flow when the carpet stretcher is in a retraction mode.

In the embodiment shown in FIG. 1, the carpet stretcher 2 includes the slotted gripper plate 6 that holds a front end 28 of the carpet stretcher stationary behind a carpet tack strip 30. Nap teeth 31 and pile teeth 32, which are coupled to the stretcher head 20, grip the carpet 4. Carpet stretching is initiated by depressing a user-operable button 34 that controls the air valve 16, as shown in FIGS. 3–4. Depressing the button causes compressed air to flow from an associated air compressor (not shown) into retraction chambers 36 of the pneumatic cylinders 24, which in turn causes the pistons 26 to retract, as shown by an arrow 38 (FIG. 2). This causes the nap teeth 31 and pile teeth 32 (FIG. 1) to pull the carpet 4 up to and over pins 40 of the tack strip 30. As shown in FIGS. 1–2, after the carpet 4 has been stretched and is firmly secured on the tack strip 30, the user releases the button 34 and allows the pistons 26, which are operatively connected to the piston rods 10, to extend slightly. The user may then pick up the carpet stretcher 2, and reposition the slotted gripper plate 6 at another location along the tack strip 30. This process is repeated along the perimeter of the room until the carpet 4 is stretched over the desired area.

Figure 5:
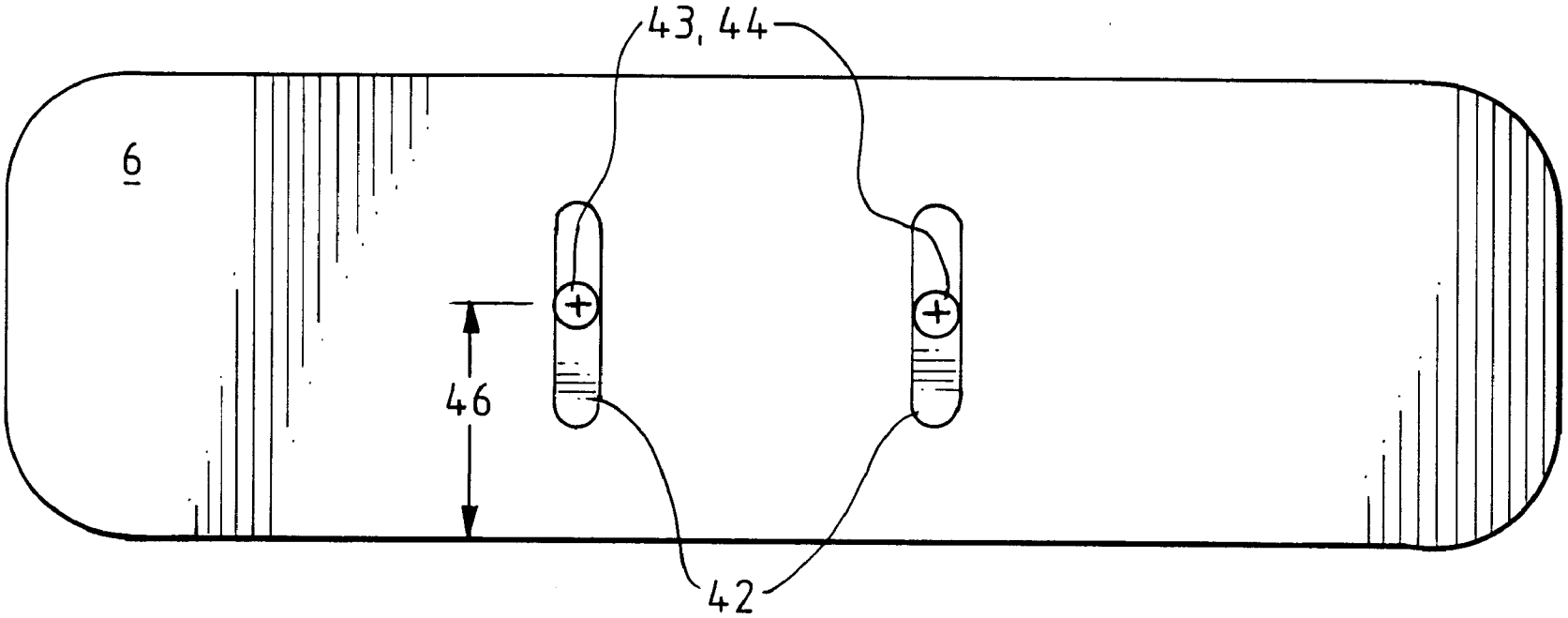
FIG. 5 depicts a front view of a slotted gripper plate.

Various configurations of gripper plates may be utilized with the invention to hold the front end of the carpet stretcher 28 in place against the carpet tack strip 30. As shown in FIGS. 1 and 5, a specific embodiment of the invention shows the slotted gripper plate 6. Slots 42 formed on the slotted gripper plate 6 (FIG. 5) allow a user to raise or lower the slotted gripper plate to ensure that the slotted gripper plate is properly secured behind the carpet tack strip 30 (FIG. 1) when the carpet stretcher 2 is used on carpets 4 of varying thickness.

In one embodiment, fasteners 43 (FIG. 5), preferably flat head machine screws, are used to connect the gripper plate 6 to the piston rod connector 8. The fasteners 43 may be left loose in the slots 42 so that the gripper plate 6 can slide vertically while adjusting to carpets 4 of varying thickness. The weight of the gripper plate 6 allows the plate 6 to slide down between the wall and the tack strip 30 when the carpet stretcher 2 is being positioned. Thus, the entire bottom edge of the gripper plate 6 rests against the floor, and the entire lower portion of the plate 6 bears on a back side of the tack strip 30 when the carpet stretcher 2 is actuated.

As shown in FIG. 1, the slotted gripper plate 6 also has low support points 44. The low support points are threaded holes within the piston rod connector 8 that are in line with the center of thrust of the carpet stretcher 6. This ensures that the slotted gripper plate 6 has a short and stiff cantilever beam portion 46. Consequently, proper alignment with the tack strip 30 is maintained. This substantially reduces injuries, which may be caused by gripper plate 6 slippage.

As shown in FIG. 1, the invention also utilizes auxiliary teeth 48 formed on a bottom portion 50 of a removable face plate 52, which is attached to a front end 54 of the housing 12. The auxiliary teeth 48 prevent the carpet 4 from "bunching-up" under the carpet stretcher 2 and spread shear load on the carpet across the length of the carpet stretcher because the carpet is gripped at more than one location along the length of the carpet stretcher. The auxiliary teeth 48 are particularly beneficial when the floor is uneven by reducing the chance of carpet stretcher 2 slippage. This reduces the risk of user injury.

Figure 6:
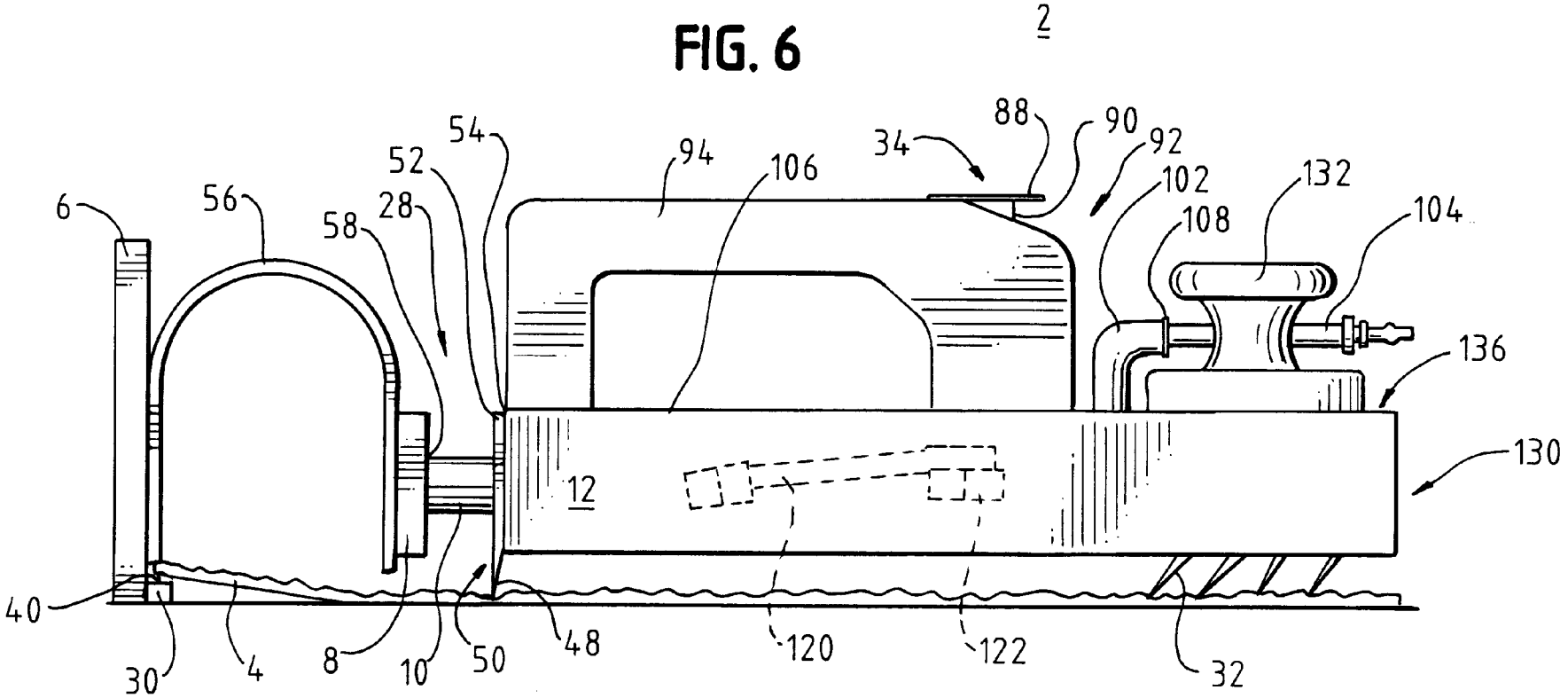
FIG. 6 depicts a specific embodiment of the carpet stretcher including a C-shaped spacer.

In the specific embodiment of FIG. 6, the slotted gripper plate 6 is operatively coupled to the piston rod connector 8 by a detachable C-shaped spacer 56. In other embodiments, the slotted gripper plate 6, or other gripper plates, can be directly connected to the piston rod connector 8 or a distal end 58 of the piston rods 10 without use of the C-shaped spacer 56 or any other spacer, as shown in FIGS. 1–2.

The C-shaped spacer 56 allows the user to position the carpet stretcher 2 at a farther distance from the tack strip 30 and vertical wall (not shown) when positioning the carpet stretcher. This feature is helpful when the carpet 4 must be stretched and pulled a greater distance to secure the carpet onto the tack strip 30. In addition, this feature allows space for the carpet 4 to 'curl up' under the C-shaped spacer 56 prior to trimming, and also provides more room to access the carpet 4 in front of the carpet stretcher 2. This advantageously allows a user to push the carpet 4 down onto the pins 40 of the tack strip 30 without picking up the carpet stretcher.

Referring now to FIGS. 3–4, an exemplary pneumatic cylinder assembly comprising the pneumatic cylinder housing 22, the pistons 26, the piston rods 10, and the pneumatic cylinders 24 is shown. One suitable pneumatic cylinder assembly 14 may be, for example, a model TB3250 pneumatic cylinder assembly, which is commercially available from Bimba Manufacturing Company, Moline, Ill.

The pneumatic cylinder housing 22 encloses a portion of the piston rods 10, the pistons 26, and the pneumatic cylinders 24. Each piston rod 10 has a proximal end 60, and the distal end 58, which is opposite the proximal end 60. The piston rods 10 are parallel and connected by the piston rod connector 8 at the distal end 58 of each piston rod.

Each pneumatic cylinder 24 has a bore 62 formed therein. Each piston 26 is operatively coupled to each piston rod 10 at the proximal end 60, and is sealingly received within the bore 62 to form an extension chamber 64 and the retraction chamber 36 within the bore 62. By detention, each retraction chamber 36 is separated from each extension chamber 64 by the piston 26. Preferably, each bore 62 has two sets of two stops 66 to assure that the pistons 26 do not slide above an extension opening 68 or below a retraction opening 70, which are described below.

In other embodiments, a wide, low-profile pneumatic cylinder assembly that incorporates a single pneumatic cylinder, one piston rod and one piston, or several pneumatic cylinders with an equal number of piston rods and pistons may be used.

The exemplary embodiment, which incorporates relatively low volume pneumatic cylinders 24, can be actuated by an air compressor (not shown) with a low PSI rating. For example, the compressor may have a rating of about 80 to 120 psi. This provides for a light weight combination of the carpet stretcher 2 and portable air compressor. Such a compact carpet stretcher 2 and air compressor can advantageously be carried by one hand in a compact bag.

As shown in FIG. 2, the carpet stretcher 2 incorporates the five way air valve 16, which is operatively coupled to a rear portion 72 of the pneumatic cylinder assembly 14. For example, the five way air valve 16 may be sealed by an adhesive to the rear portion 72 of the pneumatic cylinder assembly 14. A suitable five way air valve 16 may be, for example, a model FV4P air valve 16 which is commercially available from Clippard Instrument Laboratory, Inc., 7390 Colerain Raod, Cincinnati, Ohio 45239.

FIGS. 3–4 show an exemplary five way air valve 16 that can be used with the invention. The exemplary air valve 16 includes two vents and three ports, and includes a pneumatic portion 74 and an atmospheric portion 76. The pneumatic portion 74 includes a retraction chamber port 78 and an extension chamber port 80, while the atmospheric portion 76 includes a retraction chamber vent 82, extension chamber vent 84, and an air compressor port 86.

As depicted in FIGS. 1–2, the exemplary five way air valve 16 may be operated by the user-operable button 34, which includes a palm lever 88 and a valve stem 90 that extends through a rear portion 92 of a hand grip 94. The button 34 can be in either a depressed state or a default position. The button 34 is configured so that a user must apply a constant force to the button or constantly push down on the button to keep it in a depressed state. When no force is applied to the button 34, the button returns to an unpressed position, which is also the button's default position.

Because the button 34 only has two states, namely the default position and the depressed position, there is a sharp transition from the default position to the depressed position, which assures that there is no uncertainty in operation. This prevents accidental or inadvertent operation.

As shown in FIG. 3, when the button 34 is in an unpressed or default position, two flaps 96 within the air valve 16 are in a first (default) position. When the user depresses the button 34, the valve stem 90 (FIG. 1) is also pushed down, causing the button 34 to enter the depressed position, which causes the two flaps 96 to temporarily enter a second (depressed) state, as shown in FIG. 4. Those of ordinary skill in the art will recognize that a spring mechanism, for example, can facilitate the button 34 and flap 96 configuration described above.

When the button 34 is in the depressed state, the carpet stretcher 2 is in a retraction mode, as shown in FIG. 4. While in the retraction mode, the two flaps 96 are temporarily in a second state. In this state, the air valve 16 directs compressed air from the air compressor to the retraction chamber 36 via the air compressor port 86 and the retraction chamber port 78, and directs compressed air from the extension chamber 64 to the atmosphere via the extension chamber port 80 and the extension chamber vent 84, as shown by arrows 97. This causes the pistons 26 to retract in the direction shown by an arrow 98.

When the button 34 is in an unpressed or default position, the carpet stretcher 2 is in an extension mode, as shown in FIG. 3. While in the extension mode, the two flaps 96 return to the first position. In this state, the air valve 16 directs compressed air from the air compressor to the extension chamber 64 via the air compressor port 86 and the extension chamber port 80, and directs compressed air from the retraction chamber 36 to the atmosphere via the retraction chamber port 78 and the retraction chamber vent 82, as shown by arrows 99. This causes the pistons 26 to extend, as shown by an arrow 100.

Those skilled in the art will recognize that other valve and button configurations can direct air to the pneumatic cylinders 24 without departing from the spirit and scope of the invention. For example, a three way valve may be used that has a pneumatic portion with a retraction chamber port, and an atmospheric portion with an air compressor port and a retraction chamber vent. In such a configuration, the air compressor port would be in communication with the associated air compressor, and a retraction chamber air line would be in communication with the retraction chambers and the retraction chamber port. The air valve would either direct compressed air to the retraction chamber from the associated air compressor port, or vent compressed air to the atmosphere from the retraction chamber port, depending on the position of a user-operable button. A spring and an open vent would be positioned in each extension chamber.

Compressed air could then be directed in a number of ways. For example, when the button is depressed, compressed air could be directed to the retraction chambers, which would cause the pistons to retract and the springs to compress. When the button is in a default position, compressed air could be vented from the retraction chamber into the atmosphere, and the spring would extend, causing the pistons to extend.

The carpet stretcher 2 of FIGS. 1–2 utilizes a right angled member 102, a removable extended air nozzle 104, and the high pressure air line 18 to direct compressed air from the air compressor to the five way air valve 16. The right angled member 102 (FIG. 1) extends upwardly and outwardly from an opening (not shown) formed in a top surface 106 of the housing 12. The removable extended air nozzle 104 is attached to a first end 108 of the right angled member 102 so that the air nozzle 104 is vertically spaced and parallel with respect to the top surface 106 of the housing 12. Preferably the high pressure air line 18 extends beneath the top surface 106 of the housing 12, and is in communication with a second end 110 of the right angled member 102 and the five way air valve 16. A flexible hose (not shown) from the air compressor is attached to the air nozzle 104 so that compressed air is directed to the five way air valve 16 via the extended air nozzle through the right angled member 102, through the high pressure air line 18, and lastly to the air valve 16.

In the embodiment shown in FIGS. 1–4, a retraction air line 120 and an extension air line 122 direct air from the air valve 16 to the retraction chamber 36 and extension chamber 64. The retraction and extension air lines 120, 122 are configured to be in communication with the retraction chamber port 78 and extension chamber port 80, and the retraction opening 70 and the extension opening 68, respectively. The retraction and extension openings 70, 68 are in communication with the retraction and extension chambers 36, 64 of each cylinder 24. Preferably, as shown in FIGS. 1–2, the retraction and extension air lines 120, 122 extend from the five way air valve 16 outside the housing 12 and are concealed by a removable snap-on cover 124 that may be attached to the housing 12.

Those skilled in the art will recognize that other configurations may be used to direct air from the air valve to the retraction and extension chamber. For example, in another embodiment the extension air line may be in operative communication with an extension chamber of a first cylinder, a pathway may be in operative communication with the retraction chamber of a first pneumatic cylinder and the extension chamber of a second pneumatic cylinder, and the retraction air line may be in operative communication with a retraction chamber of the second pneumatic cylinder.

The exemplary air line configuration depicted in FIGS. 1–2 assures that all air lines 18, 120, 122 are safely concealed within the housing 12 and cover 124. This promotes quite operation, reduces the possibility of air line damage, and reduces the possibility of injury in the case of air line failure. In addition, the air line configuration promotes a compact and light-weight device.

Referring to FIG. 1, the placement of the hand grip 94 and the button 34 facilitates proper ergonomic operation. The hand grip 94 is advantageously attached to the top surface 106 of the housing 12 so that one end of the hand grip abuts the front end 54 of the housing 12 and so that a central longitudinal axis of the hand grip 94 is coaxial with a central longitudinal axis of the housing 12. The carpet stretcher 2 also incorporates a rear hand grip panel 126 that covers an exposed valve stem 90 extending through the rear portion 92 of the hand grip 94.

The hand grip 94 is designed so that thumb and forefinger overlap results during operation. Such design is less fatiguing than a wide hand grip that separates the forefinger and thumb. In a specific embodiment, the hand grip 94 can have an optimal diameter of about 1.5 inches.

The button 34 is advantageously positioned toward the rear portion 92 of the hand grip 94. This allows the user to operate the button 34 with his or her palm. Those skilled in the art will recognize that such positioning facilitates easy access and operation of the button 34 by the user, reduces finger fatigue by allowing the user to use his or her palm instead of his or her fingers to operate the button 34, and enhances the natural tendency of pushing the carpet stretcher 2 down and forward. The positioning of the hand grip 94 and button 34, moreover, allows both right handed and left handed users to operate the carpet stretcher 2. This also permits users to switch hands during operation of the carpet stretcher 2 to reduce hand fatigue. Those skilled in the art will recognize that other hand grip 94 and button 34 positioning may be incorporated without departing from the true spirit and scope of the invention.

As shown in FIGS. 1–2, the stretcher head 20 encloses nap teeth 31 and pile teeth 32. The stretcher head 20 may be, for example, a model 13240 stretcher head 20, which is commercially available from Orcon Corporation, Union City, Calif. In one embodiment, the stretcher head 20 is enclosed by and is integrally formed with a rear portion 130 of the carpet stretcher housing 12. As illustrated in FIG. 1, a pile teeth adjustment knob 132 is attached to a top surface of the stretcher head 20, and is used to raise and lower the pile teeth 32. The pile teeth adjustment knob 132 extends upwardly from a circular opening (not shown) formed in a rear portion 136 of the top surface 106 of the housing 12.

From the foregoing it will be observed that numerous modifications and variations can be effectuated without departing from the true spirit and scope of the novel concepts of the invention. It is to be understood that no limitation with respect to the specific embodiments illustrated is intended or should be inferred. The appended claims are intended to cover the illustrated embodiment and all such modifications as fall within the scope of the claims.

What is claimed is:

1. A carpet stretcher powered by an associated air compressor or other source of compressed air, the carpet stretcher comprising:

at least one pneumatic cylinder having a bore formed therein, each cylinder including:

a piston configured to be sealingly received within the bore forming an extension chamber and a retraction chamber within the bore; and a piston rod having a distal end and a proximal end opposite the distal end wherein the piston is operatively coupled to the proximal end of the piston rod;

a gripper plate operatively coupled to the distal end of the piston rod;

an air valve having air pathways configured to direct compressed air from the air compressor to the at least one pneumatic cylinder;

a user-operable button coupled to the air valve for controlling the directing of compressed air;

a stretcher head having pile teeth disposed on a surface thereof; and a housing arranged to enclose the at least one pneumatic cylinder, the air valve and the stretcher head.

2. The carpet stretcher of claim 1 further including a face plate with auxiliary teeth formed on a bottom side of the face plate, the face plate being removably attached to a front portion of the housing.

3. The carpet stretcher of claim 1 further including a hand grip attached to a top surface of the housing.

4. The carpet stretcher of claim 3 wherein the hand grip is positioned so that a front end of the hand grip is disposed toward the front portion of the housing and so that a central longitudinal axis of the handgrip is coaxial with a central longitudinal axis of the housing.

5. The carpet stretcher of claim 3 wherein the button includes a palm lever and a valve stem, the button positioned on a rear portion of the hand grip so that the palm lever is aligned with and parallel to the hand grip to permit a user to operate the button with the user's palm.

6. The carpet stretcher of claim 1 including two pneumatic cylinders wherein the piston rods of each said cylinder are connected at their distal ends by a piston rod connector, and wherein the gripper plate is coupled to the piston rod connector.

7. The carpet stretcher of claim 1 wherein the at least one pneumatic cylinder has a sufficiently small volume so that an associated air compressor having a rating of about 80 psi to 120 psi can actuate the at least one pneumatic cylinder.

8. The carpet stretcher of claim 1 including an adjustment knob connected to the stretcher head, the adjustment knob controlling a depth of the pile teeth.

9. A carpet stretcher powered by an associated air compressor or other source of compressed air, the carpet stretcher comprising:

at least two pneumatic cylinders, each having a bore formed therein, each cylinder including:

a piston configured to be sealingly received within the bore forming an extension chamber and a retraction chamber within the bore; and a piston rod having a distal end and a proximal end opposite the distal end wherein the piston is connected to the proximal end of the piston rod;

a piston rod connector configured to connect the distal end of the piston rod of each cylinder;

a gripper plate attached to the piston rod connector;

an air valve having air pathways configured to direct compressed air from the associated air compressor to the pneumatic cylinders, a user operable button coupled to the air valve for controlling the directing of compressed air;

a stretcher head including pile teeth formed on a surface thereof;

a housing arranged to enclose the pneumatic cylinders, the air valve and the stretcher head;

a face plate with auxiliary teeth formed on a bottom side thereof, the face plate being removably attached to a front portion of the housing; and a hand grip attached to a top surface of the housing.

10. The carpet stretcher of claim 9 wherein the button includes a palm lever and a valve stem, the button positioned on a rear portion of the hand grip so that the palm lever is aligned with and parallel to a main body portion of the hand grip to permit a user to operate the button with the user's palm.

11. The carpet stretcher of claim 9 further including an adjustment knob attached to the stretcher head, the adjustment knob extending through an aperture formed in a portion of the housing.

12. The carpet stretcher of claim 9 wherein the air valve is a multi-port air valve including a pneumatic portion and an atmospheric portion;

the pneumatic portion further including an extension chamber port and a retraction chamber port;

the atmospheric portion further including an air compressor port, an extension chamber vent and a retraction chamber vent;

the air compressor port configured to receive compressed air from the associated air compressor and direct the compressed air to the extension chamber port or the retraction chamber port;

the extension chamber port in communication with the extension chamber and the retraction chamber port in communication with the retraction chamber; and wherein the extension chamber vent is open to the atmosphere when the cylinders are in a retraction mode.

13. The carpet stretcher of claim 9 wherein the air valve is a multi-port air valve including a pneumatic portion and an atmospheric portion;

the pneumatic portion further including an extension chamber port and a retraction chamber port;

the atmospheric portion further including an air compressor port, an extension chamber vent and a retraction chamber vent;

the air compressor port configured to receive compressed air from the associated air compressor and direct the compressed air to the extension chamber port or the retraction chamber port;

the extension chamber port in communication with the extension chamber and the retraction chamber port in communication with the retraction chamber; and wherein the retraction chamber vent is open to the atmosphere when the cylinders are in an extension mode.

14. A carpet stretcher powered by an associated air compressor or other source of compressed air, the carpet stretcher comprising:

two pneumatic cylinders, each having a bore formed therein, each cylinder including:

a piston configured to be sealingly received within the bore forming an extension chamber and a retraction chamber within the bore; and a piston rod having distal and proximal ends wherein the piston is connected to the proximal end of the piston rod;

a piston rod connector configured to connect the distal end of the piston rod of each cylinder;

a gripper plate operatively coupled to the piston rod connector;

a multi-port air valve having a pneumatic portion and an atmospheric portion, the pneumatic portion including an extension chamber port and a retraction chamber port;

the atmospheric portion including an air compressor port, an extension chamber vent and a retraction chamber vent;

the air compressor port configured to receive compressed air from the air compressor and direct the compressed air to the extension chamber port or the retraction chamber port, the extension chamber port in communication with the extension chamber and the retraction chamber port in communication with the retraction chamber so that the retraction chamber vent is open to the atmosphere when the cylinders are in an extension mode and the extension chamber vent is open to the atmosphere when the cylinders are in a retraction mode;

a stretcher head including pile teeth formed on a surface thereof;

a housing enclosing the pneumatic cylinder, the air valve and the stretcher head;

a face plate with auxiliary teeth formed on a bottom side of the face plate, the face plate being removably attached to a front portion of the housing;

a hand grip attached to a top surface of the housing; and a user-operable button operatively coupled to the air valve for controlling the directing of compressed air, the button including a palm lever and a valve stem, the button being positioned on a rear portion of the hand grip so that the palm lever is aligned with and parallel to a main body portion of the hand grip to permit a user to operate the button with the user's palm.

15. The carpet stretcher of claim 14 wherein the pneumatic cylinders are of sufficiently small diameter and are operatively positioned in the housing to provide a carpet stretcher with a low center of thrust.

16. The carpet stretcher of claim 14 further including a right angle connector having first and second ends, the right angle connector extending through an aperture formed in the housing, the first end of the connector removably coupled to an extended air nozzle, and the second end of the connector operatively coupled to an air line disposed within the housing to provide a compact and hand holdable carpet stretcher.

17. The carpet stretcher of claim 14 wherein the main body of the hand grip has a diameter of about 1.5 inches permitting thumb and finger overlap of a user's hand during operation thereof; and the pneumatic cylinder having a sufficiently small volume so that an associated source of compressed air having a rating of about 80 psi to 120 psi can actuate the pneumatic cylinder.

18. The carpet stretcher of claim 17 further including a spacer connected to the piston rod connector, wherein the gripper plate is connected to the spacer.

19. The carpet stretcher of claim 18 wherein the gripper plate is slotted and the spacer is C-shaped.

* * * * *